US006557287B2

(12) United States Patent
Wollmann

(10) Patent No.: US 6,557,287 B2
(45) Date of Patent: May 6, 2003

(54) ARRANGEMENT INTRODUCED INTO AN EXTENSION FOR AUTOMATIC WEAPON MAGAZINE

(75) Inventor: Telmo Ricardo Wollmann, Porto Alegre (BR)

(73) Assignee: Forjas Taurus S/A (BR)

( * ) Notice: Subject to any disclaimer, the term of this patent is extended or adjusted under 35 U.S.C. 154(b) by 0 days.

(21) Appl. No.: 09/991,217

(22) Filed: Nov. 16, 2001

(65) Prior Publication Data

US 2002/0029506 A1 Mar. 14, 2002

Related U.S. Application Data

(63) Continuation-in-part of application No. 09/604,380, filed on Jun. 27, 2000, now abandoned.

(30) Foreign Application Priority Data

Jul. 6, 1999 (BR) ..... 002547

(51) Int. Cl.[7] ..... F41A 9/61
(52) U.S. Cl. ..... 42/50; 42/7
(58) Field of Search ..... 42/7, 50, 71.02

(56) References Cited

U.S. PATENT DOCUMENTS 4,995,179 A * 2/1991 Switzer ..... 42/50
5,438,783 A * 8/1995 Sniezak et al. ..... 42/50
5,584,136 A * 12/1996 Boland et al. ..... 42/50
5,666,752 A * 9/1997 Grams ..... 42/49.02

FOREIGN PATENT DOCUMENTS

DE 3607303 A1 * 9/1987 ..... F41C/25/02

* cited by examiner

*Primary Examiner*—Charles T. Jordan
*Assistant Examiner*—Kimberly S. Smith
(74) *Attorney, Agent, or Firm*—Bachman & LaPointe, P.C.

(57) ABSTRACT

Extension for an automatic pistol magazine, comprising a substantially parallelepiped box of moldable material, defined by a front wall and by lateral walls, open on the upper face thereof, wherein the lateral walls are provided with inner slide channels, one on each side and made near the upper edges, whereas the rear open portion is properly closed by a secondary body sliding downward on external rails of the rear edge of the walls in a male-female fitting, with inner channels made near the front face edges of the secondary body, locked by an elastic tongue, the tongue having a teeth that penetrates under the bottom edge of the magazine's metallic body and the front wall of extension having an anatomical shape for a better hand grasp of the pistol, lodging the little finger on the anatomical recess thereof.

4 Claims, 4 Drawing Sheets

ARRANGEMENT INTRODUCED INTO AN EXTENSION FOR AUTOMATIC WEAPON MAGAZINE

CROSS-REFERENCE TO RELATED APPLICATION

This application is a Continuation-In-Part of U.S. patent application Ser. No. 09/604,380 for ARRANGEMENT INTRODUCED INTO AN EXTENSION FOR AUTOMATIC WEAPON MAGAZINE, By Telmo Ricardo Wollmann, filed Jun. 27, 2000, now abandoned.

BACKGROUND OF THE INVENTION

The present invention relates to a new model of extensions for automatic pistol magazines. As is known in the state of the art, the small-size automatic pistols like the full size models are provided with means for the storage of cartridges in the body of clip loaders or magazines, which arrange the cartridges overlapping each other, thereby configuring a part having a predominantly vertical dimension with respect to the other dimensions and having a given number of stored cartridges.

However, due the short size of the grip it has magazines with small number of stored cartridges and it is extremely desirable to have magazines with the largest possible capacity.

It is an objective of the present model to provide a complement or extension for automatic pistol magazines, in order to increase the capacity of the magazines in a practical and quick manner, by substituting its lower end with the proposed extension.

Document MU 7600289-6 is known in the state of the art, which shows an arrangement of extensions for magazines, comprising a metallic box to be coupled to the lower end of the magazine. Such part is molded as two half-bodies, so as to have a male-female type fitting at the upper end of the main half-body for adaptation to the lower end of the magazine to be. attached, and possessing a closure by means of bolts that attach the secondary half-body to the main half-body.

Such arrangement has the drawback of possessing a bolt-type closure, which upon prolonged use may suffer from the usual problems of such type of connection, such as loosening or locking of such bolts within the seat by reason of oxidizing, etc., requiring the use of specific tools for assembly and disassembly of such complement, thereby requiring additional time and expense.

SUMMARY OF THE INVENTION

Accordingly, the scope of the extension model of the present invention is to provide not only a substantially simpler arrangement for construction thereof, by using injected materials that do not require large investments in tooling, but also to provide a complement of easy fitting and assembly, decreasing the number of operations and, therefore, decreasing the expenses thereof.

The complement in question not only allows a significant increase in the storage capacity of the cartridge magazine, making it possible to add more cartridges to the magazine, but also allows a better closing of the lower portion of the magazine, replacing the original closure, thereby providing a better finish for the magazine, but specially for increasing the total extension of the handle of the automatic pistols, by incorporation thereof to the total grip of the pistol, increasing the total grasping area of the pistol handle in the user's hand and allowing a better accommodation of the fingers on the pistol handle, since the extension is provided with a recess on the front portion thereof, facilitating the support of the user's finger on the recess.

Such scope is attained by a locking by means of proper integrated guides and a tongue integrated to the extension, rendering it more practical and with a lower components and production operations, being more reliable than the attachment by means of bolts.

Another advantage of such arrangement is to provide an anatomical projection on the rear portion thereof, without use of nuts or bolts for support of the user's hand.

Such magazine extension basically comprises a box of substantially parallelepiped shape, made of easily moldable material, to be fitted to the lower end of the automatic pistol magazines by means of sets of guides and tongues, allowing a simple and efficient fitting and possessing on the front portion thereof an anatomical recess for finger support.

BRIEF DESCRIPTION OF THE DRAWINGS

For a better description of the extension for automatic pistol magazines, a detailed description thereof is made with reference to the appended drawings, of illustrative and non-limiting nature, wherein.

DETAILED DESCRIPTION OF PREFERRED EMBODIMENTS

Figure 1:
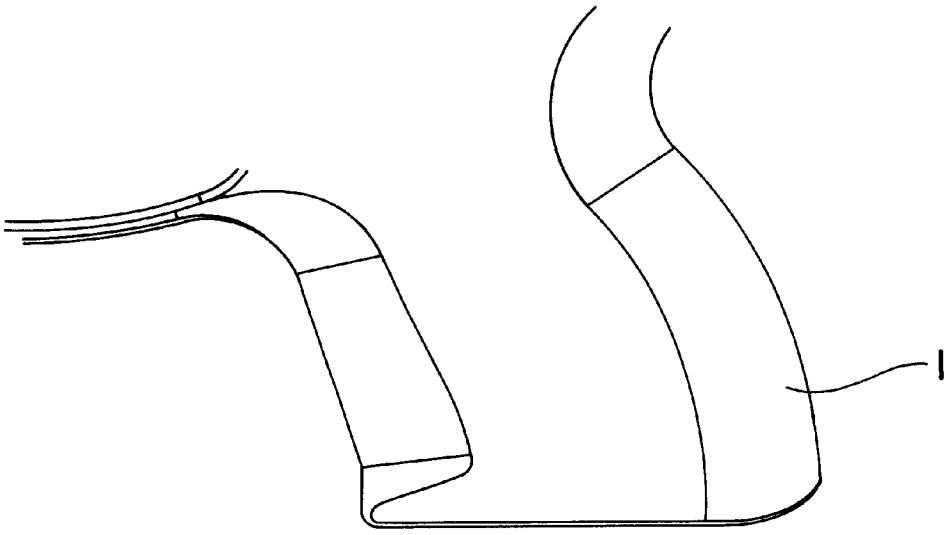
FIG. 1 PRIOR ART
FIG. 1 shows a lateral view of a little pistol with a conventional magazine.
Figure 2:
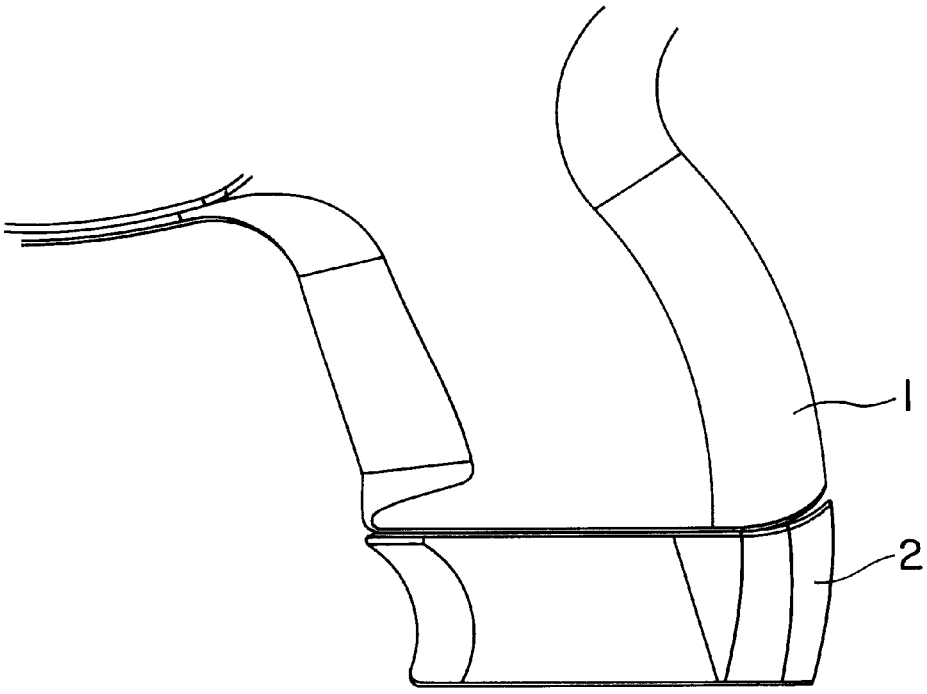
FIG. 2 shows a lateral view of the same pistol with a magazine with the extension.
Figure 3:
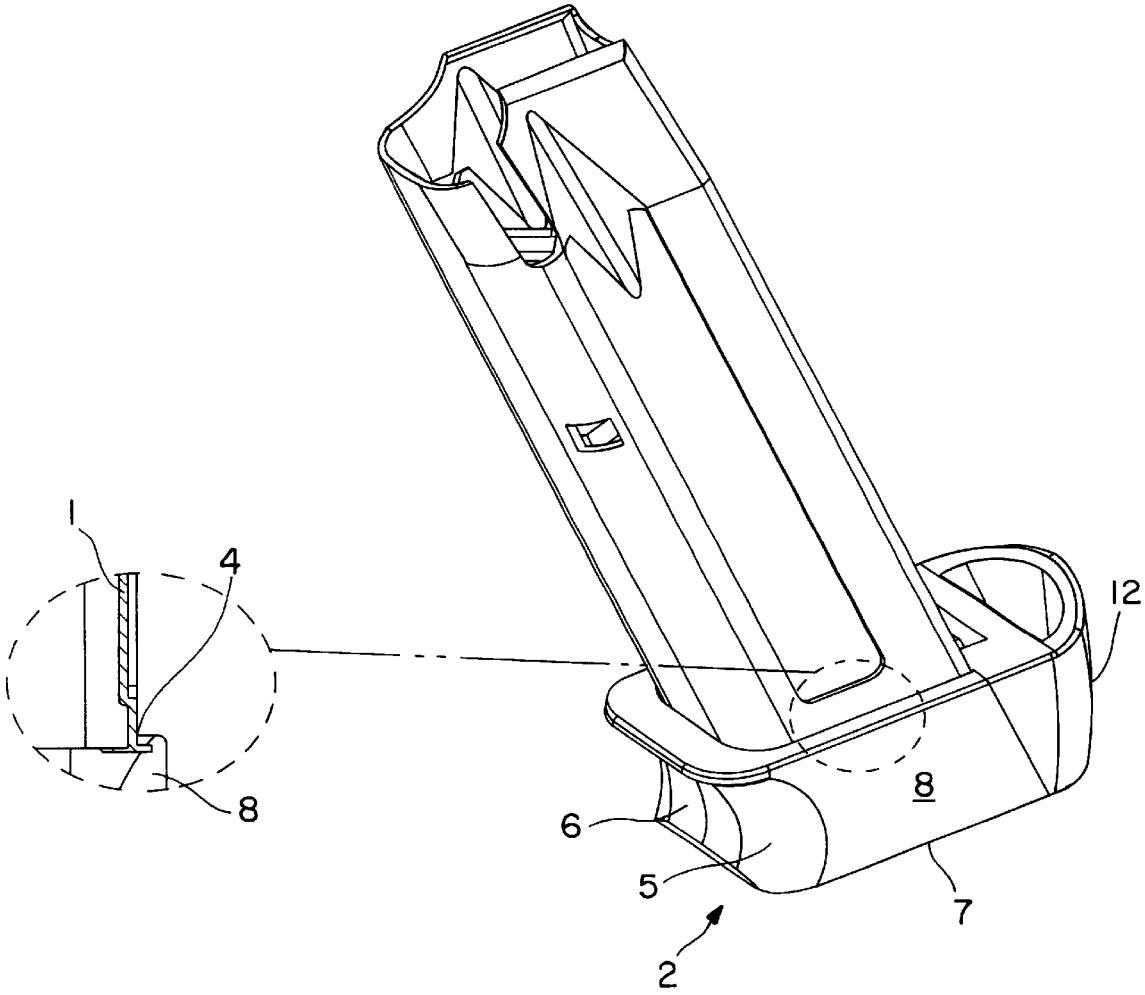
FIG. 3 is a perspective of the magazine inserted in the extension and a detail of the fitting between the magazine and the extension.
Figure 4:
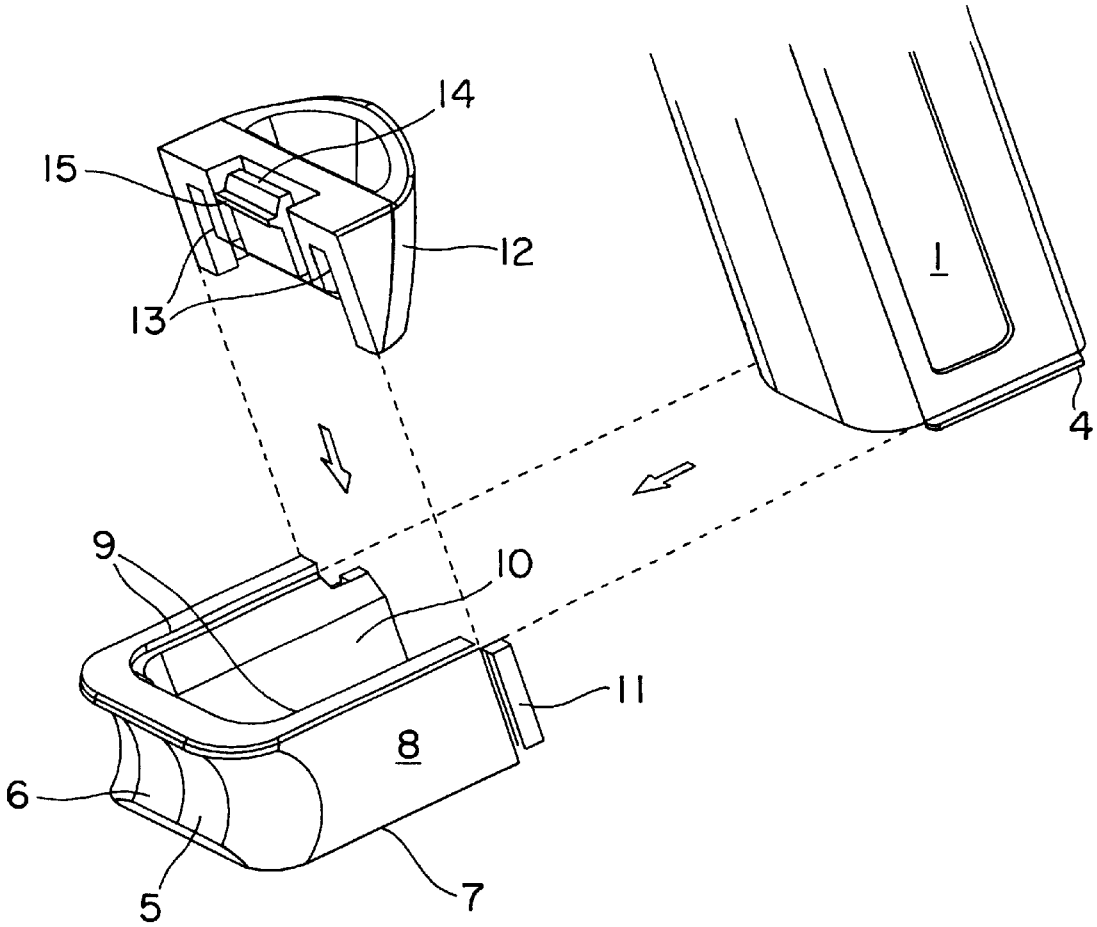
FIG. 4 is an exploded perspective view of the extension, its two components and the end of magazine.
Figure 5:
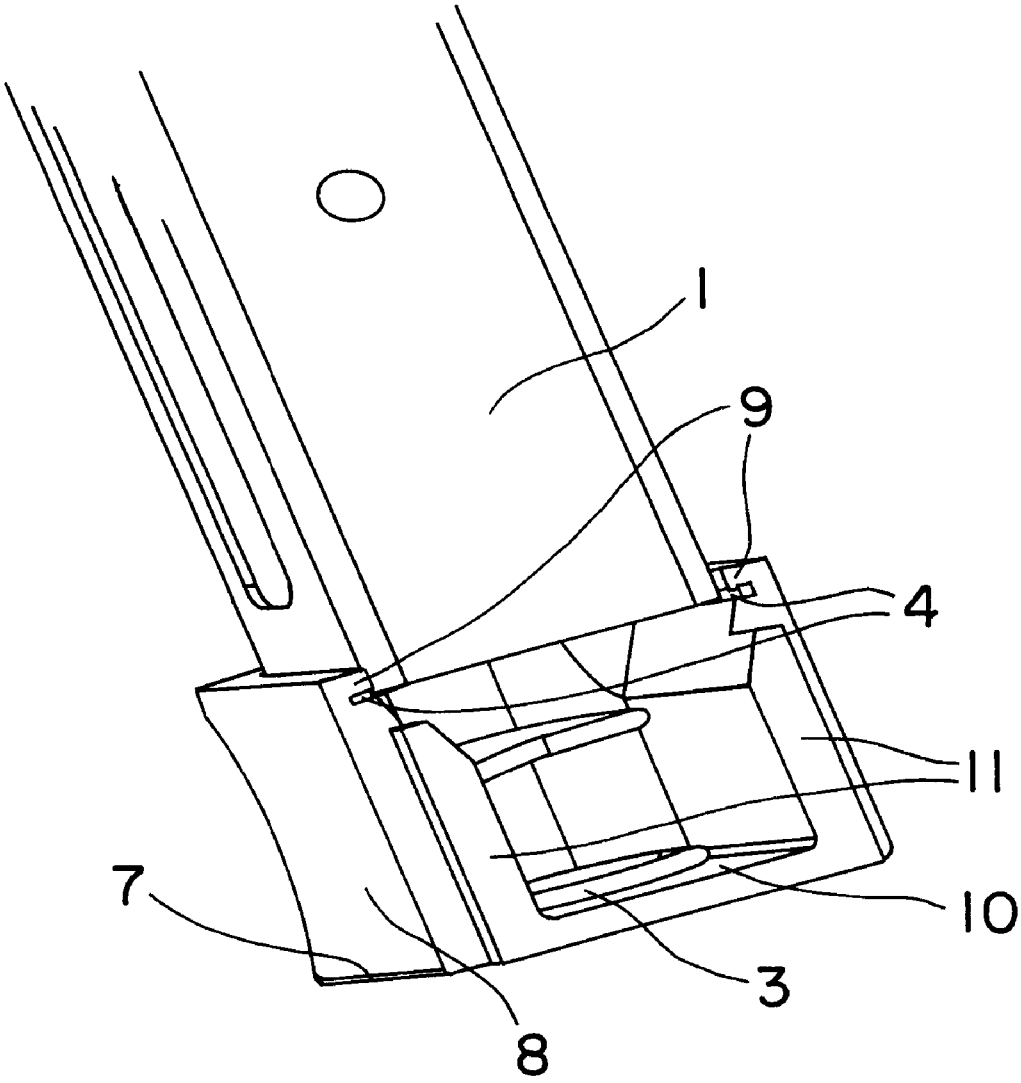
FIG. 5 shows a posterior perspective view of the magazine inserted in the secondary body 7 of the extension.

As shown in FIGS. 1 and 2, the extension 2 is fitted to the lower portion of a conventional magazine 1 and, as shown in FIG. 3, the main body of extension 2 is comprised of secondary bodies 7 and 12 (FIG. 4) that slidingly fit to each other and the extension 2 is fitting by means of guides 9 of its secondary body 7 to the magazine 1. Such guides have a simple, sliding inner fitting to the lateral ribs 4 projecting outside perpendicularly to the main axis of magazine 1 (FIG. 5)

The extension 2 has a substantially parallelepiped shape, with a cavity 10 housing the cartridges that the extension adds to the total capacity of magazine 1 and also constituting a support for the inner spring 3 and open on the upper portion thereof, having on the front wall 6 thereof an anatomic recess 5 that allows a better finger support. The extension 2 is composed of two secondary bodies or (elements 7 and 12, the secondary body 7 comprised of lateral walls 8 possessing slide guides 9 for fitting to the lower portion of a magazine 1 and possessing on the front face thereof a front wall 6 having the outer portion provided with an anatomical concave shape 5 for fitting of the user's finger and with the rear portion thereof provided with male guides 11 which slidingly fit to the secondary body 12 completing the extension 2.

The secondary body 12 has a substantially frontal plain face with female guides 13 for fitting of the male guides 11 of the secondary body 7, completing the formation of extension 2. The secondary body 12 is provided with an elastic, integrated tongue 14 to allow the attachment thereof to the magazine 1, the tongue 14 has a projection 15 that allows the locking of the secondary body to the magazine 1 by engaging on the lower edge of the rear wall of magazine 1, for integral attachment thereto.

For assembly of the extension 2, initially the secondary body 7 is attached to the magazine 1. This done by means of its guides 9 sliding back through projections or guides 4 on the lower portion of the magazine 1. The secondary body 12 is then overlapped to the secondary body 7 and slides down by means of its guides 13 through this guides 11 of the secondary body 7 and at the end of the fitting, the tongue 14 locks the assembly to the lower edge of the rear wall of the magazine 1, by means of its projection 15.

For disassembly of the extension, it is necessary to make the opposite movement, pressing the tongue 14 by means of a metallic stem, for example, a screwdriver, so that the projection 15 moves out of the lower portion of the magazine 1, allowing the disassembly of the set by sliding of the secondary body 12 upward of the secondary body 7 and after sliding thereof our of the magazine 1.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An arrangement for extension of automatic pistol magazines in order to increase capacity, which comprises:

an extension for a lower portion of said magazine, wherein the extension closes the magazine and also supports an inner spring;

the extension being coupled to said magazine by an internal slide fitting with lateral ribs of said magazine;

the extension having a shape of a box defined by two secondary bodies;

a first secondary body being formed by a front wall and lateral walls, and having an opening on an upper face thereof, where said lateral walls are provided with inner horizontal slide channels, one on each side of an first secondary body and adjacent to the A upper edge of said lateral walls;

wherein a rear open portion of the first secondary body is closed by a second secondary body sliding vertically downward on external rails of a rear edge of the lateral walls of the first secondary body in a male-female fitting with inner slide channels provided in a front face of the second secondary body;

the second secondary body being locked in a closed operating position by means of an elastic tongue, said elastic tongue having at least one tooth that penetrates under a rear wall of said magazine, fitting to the lower edge of said rear wall.

2. The arrangement according to claim 1, wherein the front wall of the first secondary body has an anatomical concavity with a recess therein for support of a finger of a shooter.

3. The arrangement according to claim 1, wherein said at least one tooth of said elastic tongue penetrates under a bottom edge of said rear wall of said magazine.

4. Extension according to claim 1, wherein said at least one tooth penetrates through a lower gap of said magazine.

* * * * *